US005393250A

United States Patent [19]

Richardson et al.

[11] Patent Number: 5,393,250

[45] Date of Patent: Feb. 28, 1995

[54] CAM ACTION ELECTRICAL EDGE CONNECTOR

[75] Inventors: Kim L. Richardson, Herriman; Gregory D. Quickel, Salt Lake City, both of Utah

[73] Assignee: Becton, Dickinson and Company, Franklin Lakes, N.J.

[21] Appl. No.: 57,227

[22] Filed: May 4, 1993

[51] Int. Cl.[6] ..... H01R 13/05

[52] U.S. Cl. ..... 439/825; 439/692

[58] Field of Search ..... 439/668, 669, 633, 692, 439/693, 593, 594, 595, 59, 60, 374

[56] References Cited

U.S. PATENT DOCUMENTS 2,524,701 10/1950 Grill ..... 439/670
5,085,601 2/1992 Buchter et al. ..... 439/79
5,137,467 8/1992 Arai ..... 439/374

*Primary Examiner*—David L. Pirlot
*Attorney, Agent, or Firm*—Eric M. Lee; Michael G. Schwarz

[57] ABSTRACT

An electrical connector is disclosed. The connector is made up of an electrical connector comprising: a first (female) housing and a second (male) housing, the first and second housings being capable of mating by being brought together along an axis, such that when the housings are mated the second housing lies at least partially within the first housing. Mounted in the first housing is a first conductor. The first conductor has a fixed end mounted in the housing and a free end and is biased in a first direction substantially transverse to the axis. A second conductor is mounted in the second housing at a position in relation to the axis such that when the first and second housings are mated the first conductor is adjacent the second conductor. A camming means is mounted in the second housing for interacting with the first conductor on mating of the housings. The camming means is made up of a ramp a ramp having a base, a camming surface sloping from a minimum height at the base and a maximum height, and a downward step at the maximum height. The second conductor is mounted adjacent the downward step. When the first and second housings are brought together to mate along the axis, the first conductor comes into contact with the ramp and the camming surface pushes the first conductor against the bias of the first conductor. When the first and second housings are fully mated, the bias of the first conductor causes the free end of the first conductor to move in the first direction and thus into contact with the second conductor.

3 Claims, 5 Drawing Sheets

CAM ACTION ELECTRICAL EDGE CONNECTOR

BACKGROUND

This invention lies in the field of connectors for releasably connecting electrical conductors. More specifically it relates to an connector which permits the releasable connection of electrical conductors without significantly degrading the surfaces of such conductors by repeated frictional contact between the surfaces of the conductors.

SUMMARY OF THE INVENTION

This invention is an electrical connector which permits electrical conductors to be interconnected without one conductor excessively wiping against another. Thus damage to the conductors is minimized when contact between the conductors is made or broken. Excessive wiping is undesirable because it may cause material to be removed from the conductors and their surfaces to be degraded, reducing the service life of the conductors.

The present invention comprises a connector having two parts which can be interconnected. Each part carries a set of conductors or as few as one conductor. The conductors of at least one part are resilient. When the two parts are brought together, the conductors of both parts are kept separate from each other until just before electrical contact is to be made. When contact is to be made the conductors which are to be interconnected are automatically brought together by a springing as a result of the two parts being brought together.

The invention is made up of an electrical connector comprising a first (female) housing and a second (male) housing. The first and second housings are capable of mating by being brought together along an axis, such that when the housings are mated the second housing lies at least partially within the first housing. Mounted in the first housing is a first conductor. The first conductor has a fixed end mounted in the housing and a free end and is biased in a first direction substantially transverse to the axis. A second conductor is mounted in the second housing at a position in relation to the axis such that when the first and second housings are mated the first conductor is adjacent the second conductor. A camming means is mounted in the second housing for interacting with the first conductor on mating of the housings. The camming means is made up of a ramp having a base and an apex. A camming surface slopes from a minimum height at the base to a maximum height at the apex. The second conductor is mounted adjacent a downward step.

When the first and second housings are brought together to mate along the axis, the first conductor comes into contact with the ramp and the camming surface pushes the first conductor against the bias of the first conductor. When the first and second housings are fully mated, the bias of the first conductor causes the free end of the first conductor to move in the first direction and thus into contact with the second conductor.

DETAILED DESCRIPTION

The following description is of a preferred embodiment of the invention. It is intended to be exemplary of the invention rather than limiting. The full scope of the invention is to be determined with reference to the claims and their equivalents.

Figure 1:
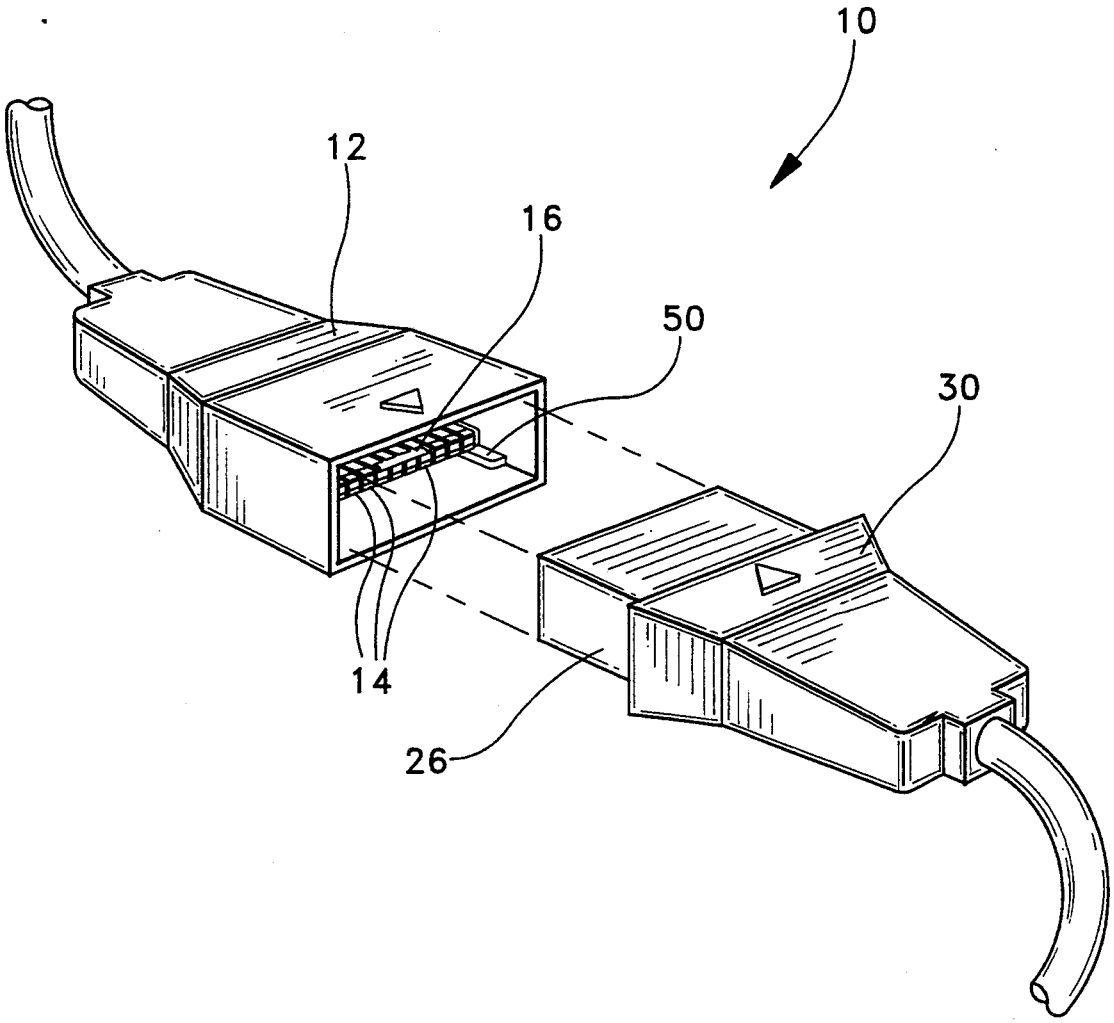
FIG. 1 is a perspective view of the first and second housings of the invention in their unmated state.
Figure 2:
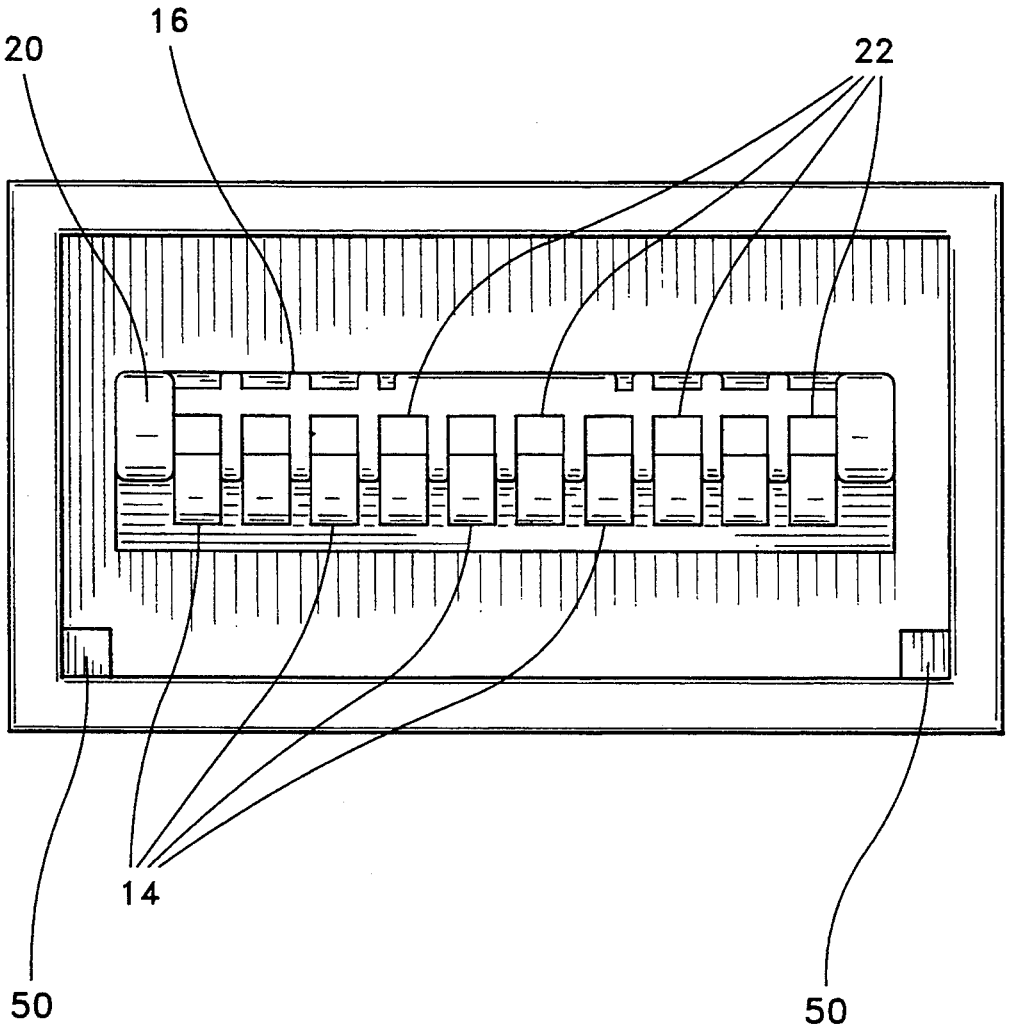
FIG. 2 is a front view of the first (female) housing from direction 'A' in FIG. 3.
Figure 3:
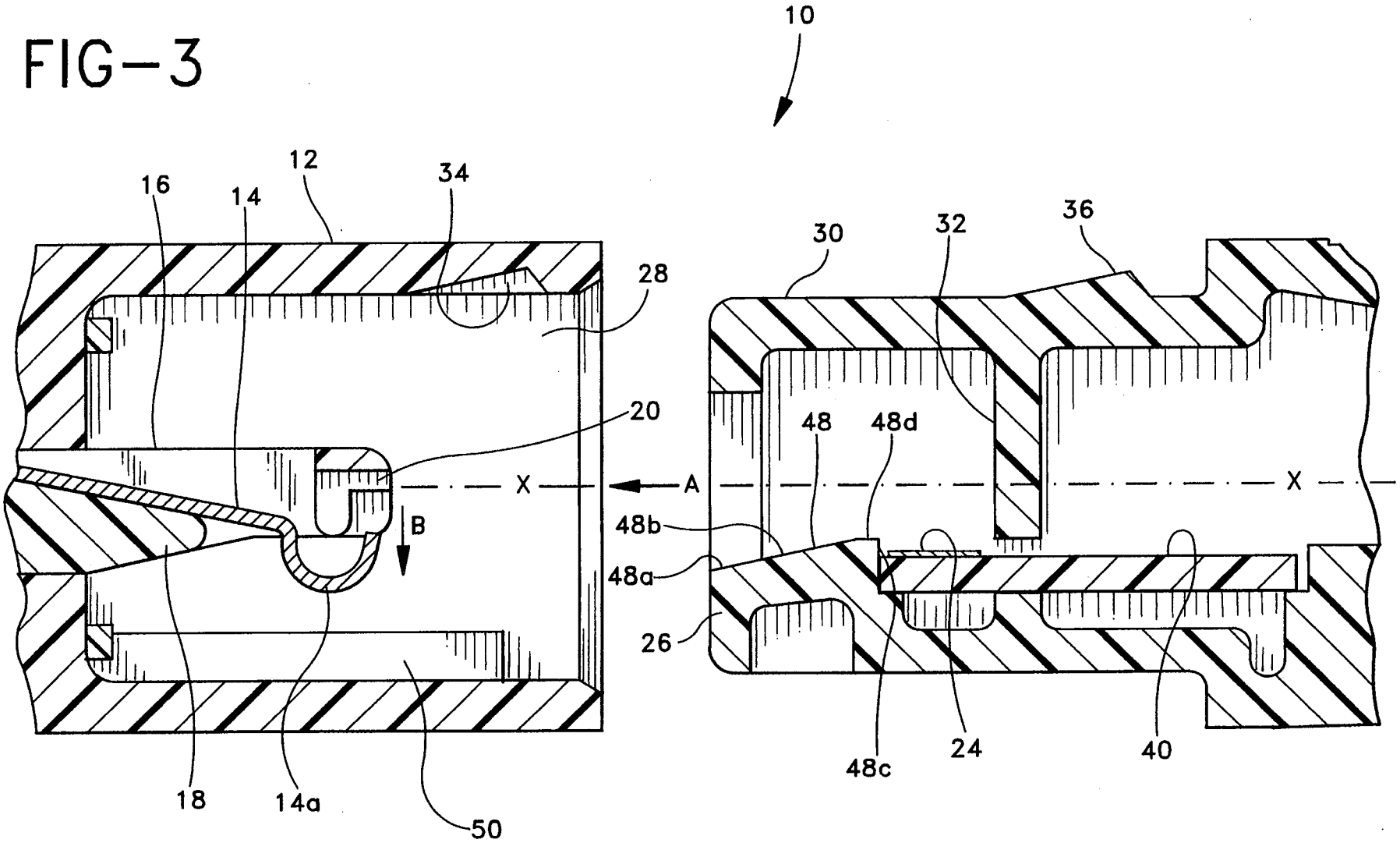
FIG. 3 is a cross-sectional view of the invention in its unmated state.

Connector 10 is shown in its unmated state in FIG. 1. First (female) housing 12 holds a plurality of conductors 14 which are leaf-like resilient gold plated copper conductors having a thickness of approximately 0.125 mm and a width of 0.9 mm. The term "plurality" is intended to mean any natural number greater than or equal to one. First housing 12 has a cavity 28 into which conductors 14 protrude. Conductors 14 have free ends 14*a* and fixed ends 14*b*. Conductors 14 are thus mounted in first housing 12 in a cantilevered manner. Specifically, conductors 14 are each housed in slots 22 on conductor guide 16 (See FIGS. 1 and 3) A cantilevered conductor guide 16 is mounted in a cantilevered manner into housing 12 so that it protrudes into cavity 28. Conductor guide 16 limits the cantilever movement of conductors 14 so that they remain substantially centered in housing 28. Conductors 14 lie on one side of conductor guide 16 along its length in cavity 28. Conductor guide 16 is provided with ramp 18 and protrusion 20 which restrict the cantilever movement of conductor 14.

Second (male) housing 30 is dimensioned to mate with cavity 28 of first housing 12. Second housing 30 carries second conductors 24 which are to be connected to conductor 14. Conductors 24 comprise a gold trace conductor corresponding to each conductor 14. The copper conductors are fixed to an alumina substrate 40. Conductors 24 are located within cavity 32 of second housing. The mating portion 26 of second housing 30 has walls, one of which is provided with a camming means in the form of ramp 48 adjacent substrate 40. Ramp 48 has a base 48*a*, a camming surface 48*b* and downward a step 48*c*. Ramp 48 slopes from a minimum height at base 48*a* to a maximum height at apex 48*d*.

First and second housings are generally symmetrical about axis X—X. Conductors 14 are biased away from axis in the direction of arrow B.

Figure 4:
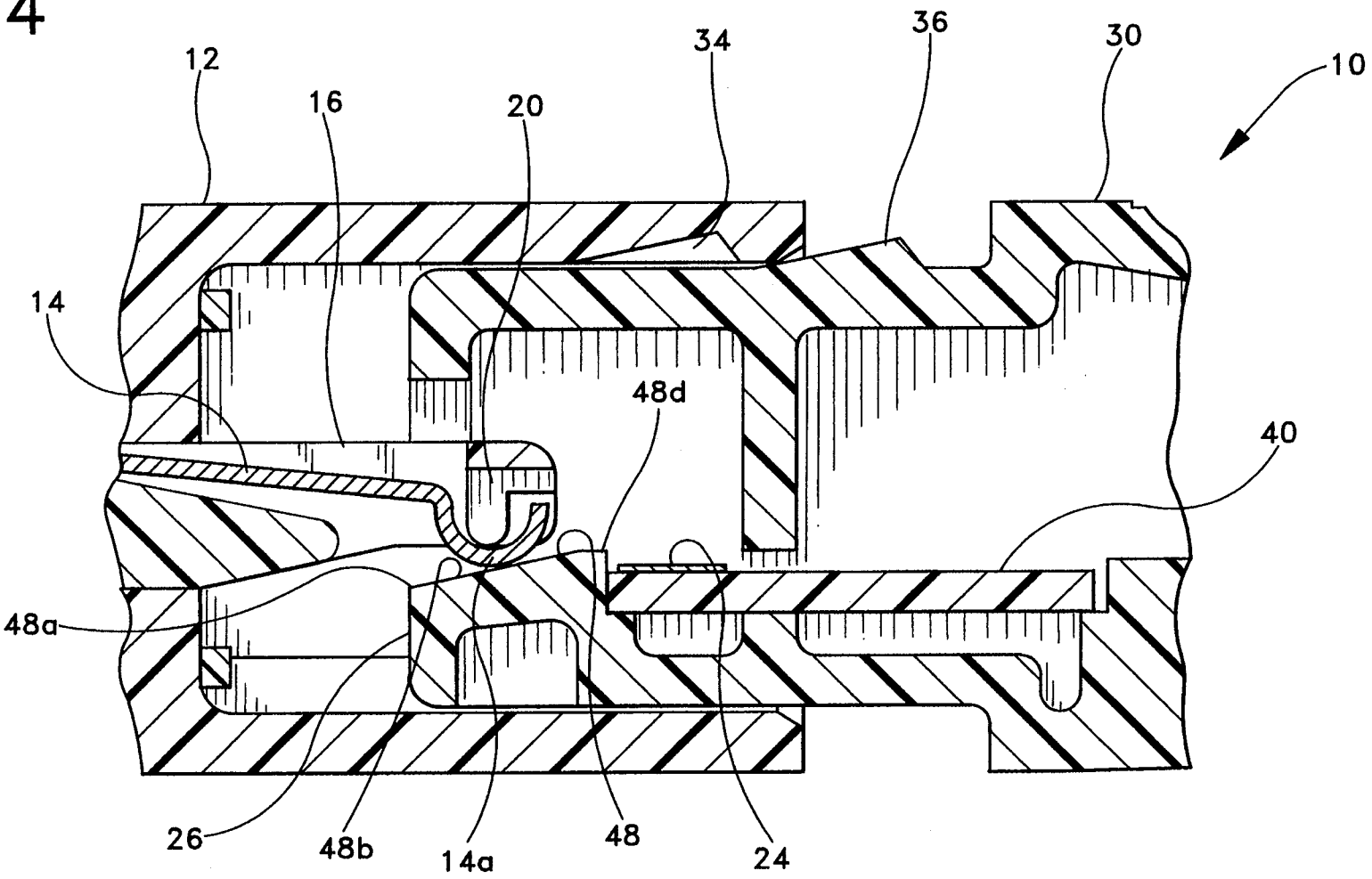
FIG. 4 is a cross-sectional view of the invention in its partially mated state.
Figure 5:
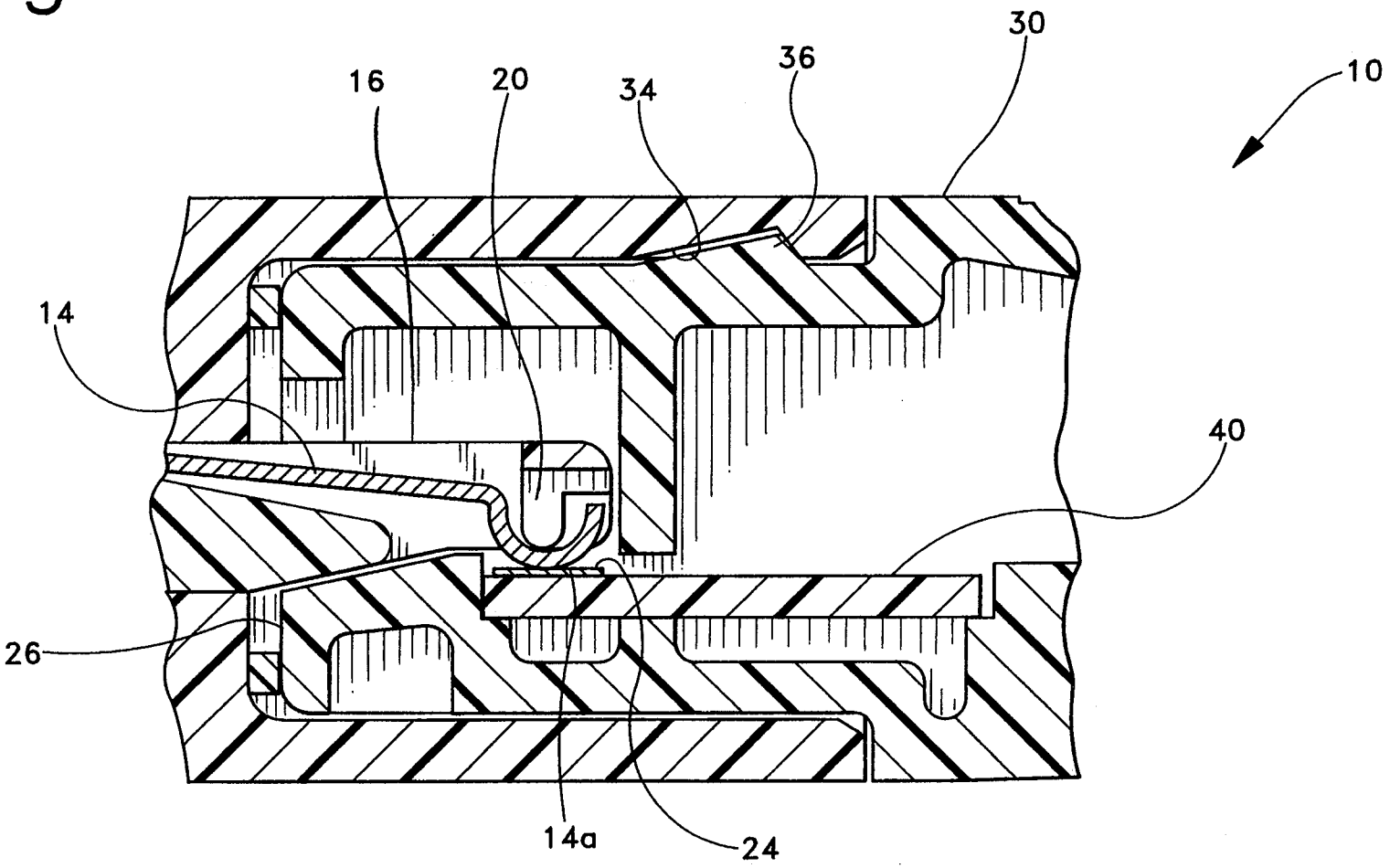
FIG. 5 is a cross-sectional view of the invention in its fully mated state.

Conductors 14 are oriented In first housing 12 such that when the axes of first and second housings 12 and 30 are brought together along axis X—X, conductors 14 are aligned with the base 48*a* of ramp 48. When housings 12, 30 are brought together as shown in FIG. 4, conductors 14 come into contact with camming surface 48*b* of ramp 48. Further mating of housings 12, 30 results in conductors 14 being pushed against their bias by ramp 48 towards protrusion 20 on conductor guide 16. The resilience of conductors 14 causes conductors 14 to remain in contact with ramp 48 as housings 12 and 30 are brought together. Further mating of housings 12 and 30 causes conductors 14 to reach the top 48*d* of ramp 48 and then to drop off step 48*c* down onto second conductors 24 due to the bias of conductors 14. When housings 12 and 30 are fully mated, conductor guide 16 abuts wall 32 of housing 30, thus preventing further relative axial movement of housings 12, 30 as shown in FIG. 5.

Housings 12 and 30 are provided with detents 34 and 36 which releasably lock housings 12 and 30 together. An orientation key 50 is provided to ensure that the housings are correctly oriented so that conductors 14 and 24 are properly aligned.

The housings 12 and 30 can be separated and contact between conductors 14 and 24 can be broken by pulling against the forces between detents 34 and 36. Conductors 14 will thus be lifted off conductors 24 by the top 50 of ramp 48.

Although the invention has been described with the fixed conductor being in the male housing and the cantilevered conductor in the female housing, it will be appreciated that the conductors could be transposed. It is intended that the invention with the conductors transposed is equivalent to the invention as described.

What is claimed is:

1. An electrical connector comprising:

a first housing and a second housing, the first and second housings being capable of mating by being brought together along an axis, such that when the housings are mated one of the housings lies at least partially within the other housing;

a first conductor mounted in the first housing and having a free end, the first conductor being biased in a first direction substantially transverse to the axis;

a cam mounted in the second housing adjacent a proximal end of the second housing for interacting with the first conductor on mating of the housing, the cam having a ramp with a base and an apex, a camming surface sloping from a minimum height at the base and a maximum height at the apex, and a downward step extending substantially perpendicularly from the apex; and a second conductor mounted in the second housing on a substrate adjacent to and axially rearward of the downward step, wherein when the first and second housings are brought together to mate along the axis, the first conductor comes into contact with the ramp and the camming surface pushes the first conductor against the bias of the first conductor until, when the first and second housings are fully mated and the first conductor reaches the apex, the bias of the first conductor causes the free end of the first conductor to move in the first direction and thus into contact with the second conductor upon forward axial movement of the first housing.

2. The electrical connector of claim 1 further comprising a conductor guide mounted in the first housing to restrict movement of the first conductor.

3. The electrical connector of claim 1 wherein the conductor guide comprises a ramp to restrict the movement of the first conductor.

* * * * *